US009050502B1

(12) United States Patent
Bartels et al.

(10) Patent No.: US 9,050,502 B1
(45) Date of Patent: Jun. 9, 2015

(54) GOLF BALL WITH DUAL POLYBUTADIENE CORES AND DUAL MANTLE LAYERS

(71) Applicant: Callaway Golf Company, Carlsbad, CA (US)

(72) Inventors: David Bartels, Carlsbad, CA (US); Steve Ogg, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 147 days.

(21) Appl. No.: 13/767,111

(22) Filed: Feb. 14, 2013

Related U.S. Application Data

(63) Continuation-in-part of application No. 13/451,160, filed on Apr. 19, 2012, now Pat. No. 8,475,298, which is a continuation-in-part of application No. 13/091,937, filed on Apr. 21, 2011, now Pat. No. 8,425,351, application No. 13/767,111, which is a continuation-in-part of application No. 13/253,299, filed on Oct. 5, 2011, and a continuation-in-part of application No. 13/269,208, filed on Oct. 7, 2011, now Pat. No. 8,876,635, and a continuation-in-part of application No. 13/253,281, filed on Oct. 5, 2011, now Pat. No. 8,651,976.

(60) Provisional application No. 61/619,850, filed on Apr. 3, 2012, provisional application No. 61/330,127, filed on Apr. 30, 2010, provisional application No. 61/391,181, filed on Oct. 8, 2010, provisional application No. 61/391,783, filed on Oct. 11, 2010, provisional application No. 61/390,550, filed on Oct. 6, 2010.

(51) Int. Cl.
*A63B 37/04* (2006.01)
*A63B 37/00* (2006.01)

(52) U.S. Cl.
CPC ..... *A63B 37/0076* (2013.01); *A63B 37/0081* (2013.01); *A63B 37/0043* (2013.01); *A63B 37/0045* (2013.01); *A63B 37/0062* (2013.01); *A63B 37/0065* (2013.01)

(58) Field of Classification Search
CPC ..... A63B 37/0043; A63B 37/0045; A63B 37/0062; A63B 37/0065; A63B 37/0076
USPC ..... 473/371–374, 376, 377
See application file for complete search history.

(56) References Cited

U.S. PATENT DOCUMENTS

| | | | |
|---|---|---|---|
| 4,911,451 | A | 3/1990 | Sullivan et al. |
| 4,986,545 | A | 1/1991 | Sullivan |
| 5,048,838 | A | 9/1991 | Chikaraishi et al. |
| 5,252,652 | A | 10/1993 | Egashira et al. |
| 5,588,924 | A | 12/1996 | Sullivan et al. |
| 5,688,595 | A | 11/1997 | Yamagishi et al. |

(Continued)

OTHER PUBLICATIONS

Jeff Dalton, Compressions by any other name.*

(Continued)

*Primary Examiner* — John E Simms, Jr.
(74) *Attorney, Agent, or Firm* — Michael A. Catania; Sonia Lari; Rebecca Hanovice

(57) ABSTRACT

A golf ball comprising a core comprising an inner core center and an outer core layer disposed over the inner core center. An inner mantle layer is disposed over the core, an outer mantle is disposed over the inner mantle layer, and a cover is disposed over the outer mantle. The golf ball preferably has a core compression ratio of greater than 150.

5 Claims, 3 Drawing Sheets

(56) References Cited

U.S. PATENT DOCUMENTS

| | | | | |
|---|---|---|---|---|
| 5,721,304 | A | 2/1998 | Pasqua | |
| 5,725,442 | A | 3/1998 | Higuchi et al. | |
| 5,733,205 | A * | 3/1998 | Higuchi et al. | 473/376 |
| 5,779,562 | A | 7/1998 | Melvin et al. | |
| 5,816,937 | A | 10/1998 | Shimosaka et al. | |
| 5,830,086 | A | 11/1998 | Hayashi et al. | |
| 5,980,396 | A | 11/1999 | Moriyama et al. | |
| 6,068,561 | A * | 5/2000 | Renard et al. | 473/364 |
| 6,117,026 | A | 9/2000 | Hayashi et al. | |
| 6,123,630 | A | 9/2000 | Hayashi et al. | |
| 6,142,886 | A | 11/2000 | Sullivan et al. | |
| 6,248,027 | B1 | 6/2001 | Hayashi et al. | |
| 6,251,031 | B1 | 6/2001 | Hayashi et al. | |
| 6,277,034 | B1 | 8/2001 | Nesbitt et al. | |
| 6,299,550 | B1 | 10/2001 | Molitor et al. | |
| 6,361,454 | B1 | 3/2002 | Yoshida et al. | |
| 6,461,251 | B1 * | 10/2002 | Yamagishi et al. | 473/376 |
| 6,468,169 | B1 | 10/2002 | Hayashi et al. | |
| 6,495,633 | B1 | 12/2002 | Sullivan et al. | |
| 6,520,870 | B2 | 2/2003 | Tzivanis et al. | |
| 6,565,455 | B2 | 5/2003 | Hayashi et al. | |
| 6,565,456 | B2 | 5/2003 | Hayashi et al. | |
| 6,626,770 | B2 | 9/2003 | Takemura et al. | |
| 6,653,382 | B1 | 11/2003 | Statz et al. | |
| 6,685,579 | B2 | 2/2004 | Sullivan | |
| 6,705,956 | B1 | 3/2004 | Moriyama et al. | |
| 6,716,117 | B2 * | 4/2004 | Ichikawa et al. | 473/378 |
| 6,743,122 | B2 | 6/2004 | Hayashi et al. | |
| 6,849,006 | B2 | 2/2005 | Cavallaro et al. | |
| 6,994,638 | B2 | 2/2006 | Rajagopalan et al. | |
| 7,121,959 | B1 | 10/2006 | Yoshida et al. | |
| 7,226,367 | B2 | 6/2007 | Higuchi et al. | |
| 7,300,363 | B2 * | 11/2007 | Kasashima | 473/376 |
| 7,335,114 | B2 | 2/2008 | Hebert et al. | |
| 7,361,102 | B2 | 4/2008 | Ladd et al. | |
| 7,537,531 | B2 | 5/2009 | Ladd et al. | |
| 7,591,741 | B2 | 9/2009 | Sullivan et al. | |
| 7,874,939 | B2 | 1/2011 | Sullivan et al. | |
| 8,025,593 | B2 | 9/2011 | Rajagopalan et al. | |
| 8,109,843 | B2 | 2/2012 | Hebert et al. | |
| 2006/0252577 | A1 * | 11/2006 | Sullivan et al. | 473/354 |
| 2007/0265113 | A1 * | 11/2007 | Hirau et al. | 473/376 |
| 2009/0111609 | A1 * | 4/2009 | Watanabe et al. | 473/373 |
| 2010/0075778 | A1 * | 3/2010 | Kamino et al. | 473/376 |
| 2011/0009212 | A1 * | 1/2011 | Goguen et al. | 473/372 |

OTHER PUBLICATIONS

Compressions by any other name—J. Dalton.*

* cited by examiner

GOLF BALL WITH DUAL POLYBUTADIENE CORES AND DUAL MANTLE LAYERS

CROSS REFERENCES TO RELATED APPLICATIONS

The present application claims priority to U.S. Provisional Patent Application No. 61/619,850, filed on Apr. 3, 2012. The present application is a continuation-in-part application of U.S. patent application Ser. No. 13/451,160, filed on Apr. 19, 2012, which is a continuation-in-part application of U.S. patent application Ser. No. 13/091,937, filed on Apr. 21, 2011, which claims priority to U.S. Provisional Patent Application No. 61/330,127 field on Apr. 30, 2010. The present application is a continuation-in-part application of U.S. patent application Ser. No. 13/253,299, filed on Oct. 5, 2011, which claims priority to U.S. Provisional Patent Application No. 61/391,181, filed on Oct. 8, 2010. The present application is a continuation-in-part application of U.S. patent application Ser. No. 13/269,208, filed on Oct. 7, 2011, which claims priority to U.S. Provisional Patent Application No. 61/391,783, filed on Oct. 11, 2010. The present application is a continuation-in-part application of U.S. patent application Ser. No. 13/253,281, filed on Oct. 5, 2011, which claims priority to U.S. Provisional Patent Application No. 61/390,550, filed on Oct. 6, 2010. All of the above listed patent applications are hereby incorporated by reference in their entireties.

STATEMENT REGARDING FEDERALLY SPONSORED RESEARCH OR DEVELOPMENT

Not Applicable

BACKGROUND OF THE INVENTION

1. Field of the Invention

The present invention relates to golf balls. Particularly to golf balls having five layers including a dual core, a dual mantle and a thermoplastic polyurethane cover.

2. Description of the Related Art

Sullivan et al., U.S. Pat. No. 4,911,451, for a Golf Ball Cover Of Neutralized Poly(ethylene-acrylic acid) Copolymer, discloses in Table One a golf ball having a compression of below 50 and a cover composed of ionomers having various Shore D hardness values ranging from 50 to 61.

Sullivan, U.S. Pat. No. 4,986,545, for a Golf Ball discloses a golf ball having a Rhiele compression below 50 and a cover having Shore C values as low as 82.

Egashira et al., U.S. Pat. No. 5,252,652, for a Solid Golf Ball, discloses the use of a zinc pentachlorothiophenol in a core of a golf ball.

Pasqua, U.S. Pat. No. 5,721,304, for a Golf Ball Composition, discloses a golf ball with a core having a low compression and the core comprising calcium oxide.

Sullivan, et al., U.S. Pat. No. 5,588,924, for a Golf Ball discloses a golf ball having a PGA compression below 70 and a COR ranging from 0.780 to 0.825.

Sullivan et al., U.S. Pat. No. 6,142,886, for a Golf Ball And Method Of Manufacture discloses a golf ball having a PGA compression below 70, a cover Shore D hardness of 57, and a COR as high as 0.794.

Tzivanis et al., U.S. Pat. No. 6,520,870, for a Golf Ball, discloses a golf ball having a core compression less than 50, a cover Shore D hardness of 55 or less, and a COR greater than 0.80.

Core durability is a limiting factor as to how large of a compression differential you can build into the construction. In a conventional 4-piece construction a dual core with a high compression differential can have a tendency to fail (ie. break) if it experiences high impact forces. The impact forces cause high stress forces in the mantle layer which are focused around the stress concentrations introduced in the injection molding process, most notably around the pins and gates. When the stress increases beyond the tensile strength of the material the protective mantle layer fails and as a result the core sees the majority of the force and cracks.

A standard test that is used to evaluate this is the PTM cannon which fires ball into a rigid, steel plate at 200 fps. The threshold for acceptable durability is a Mean Time to Failure (MTTF)≥30 blows with no breaks below 10 blows. This test is conducted with 24 balls and plotted using a Weibull plot to establish these values.

BRIEF SUMMARY OF THE INVENTION

In the present invention, the dual core compression differential is maximized by the additional of a multi-layer mantle. The second mantle layer increases the strength of the mantle system by fusing with the inner mantle and orienting its areas of stress concentrations randomly with respect to the inner mantle. The two layers together prevent the stress concentrations from developing cracks and provide the strength to withstand the large impact forces, thereby keeping the dual core from seeing the high forces that would cause it to crack.

This multi-layer mantle system allows us to soften the inner core and increase the compression of the outer core beyond what is possible in a single mantle construction.

A value called the Core Compression Ratio (CCR) which is a function of the inner core compression, dual core compression, and volume of the outer core layer.

CCR=(inner core deflection[in]*100)/(outer core volume[in^3]*dual core deflection).

A high CCR value corresponds to a high compression differential between the inner and outer core materials, which results in excellent ball performance preferred by the best players in the world.

Dual core golf ball with a multi-layer mantle system to enhance durability and allow for a great differential between the inner and outer core compressions.

Dual core offers a performance benefit due to the impact dynamics of the soft inner core and firm outer core. When struck with higher impact forces, the soft inner core plays a relatively larger role and compresses more during impact. This compression reduces the torque exerted on the ball because it has a shorter moment arm, and thus reduces the spin. This is most noticeable during a high speed driver impact, or impacts with long irons (e.g. 6-iron). When struck with clubs that are more lofted, the normal force exerted on the ball is less and the tangential force is greater, causing the outer core to play a relatively larger role in the dynamics of the core. Due to the smaller normal force the core retains it shape better and more torque is created due to the longer moment arm. Therefore, by adjusting the relative compressions of the inner and outer cores you can affect the spin with longer clubs (lower spin with woods and long irons) as well as around the green (higher spin with wedges).

One aspect of the present invention is a golf ball. The golf ball has a core, dual mantle and cover. The core comprises an inner core and an outer core disposed over the inner core. The inner mantle layer is disposed over the outer core. The inner mantle layer has a thickness ranging from 0.025 inch to 0.070 inch. The outer mantle layer is disposed over the inner mantle layer. The outer mantle layer has a thickness ranging from 0.025 inch to 0.040 inch. The cover layer is disposed over the outer mantle layer. The cover layer has a thickness ranging from 0.025 inch to 0.050 inch. The golf ball has a diameter of at least 1.68 inches. The golf ball has a core compression ratio (CCR)≥150, wherein CCR=(an inner core deflection×100)/(outer core volume×dual core deflection) and wherein the inner core defection value is in inches under a load of 200 pounds, the outer core volume is in inches cubed, and the dual core deflection is in inches under a load of 200 pounds.

Another aspect of the present invention is golf ball. The golf ball has a core, dual mantle and cover. The core comprises an inner core and an outer core disposed over the inner core. The inner mantle layer is disposed over the outer core. The inner mantle layer has a thickness ranging from 0.025 inch to 0.070 inch. The outer mantle layer is disposed over the inner mantle layer. The outer mantle layer has a thickness ranging from 0.025 inch to 0.040 inch. The cover layer is disposed over the outer mantle layer. The cover layer has a thickness ranging from 0.025 inch to 0.050 inch. The golf ball has a diameter of at least 1.68 inches. The golf ball has a core compression ratio (CCR)≥125, wherein a diameter of the core is less than 1.495 inches, and wherein CCR=(an inner core deflection×100)/(outer core volume×dual core deflection) and wherein the inner core defection value is in inches under a load of 200 pounds, the outer core volume is in inches cubed, and the dual core deflection is in inches under a load of 200 pounds.

Another aspect of the present invention is a golf ball comprising a core, mantle and cover. The core comprises an inner core and an outer core disposed over the inner core. The inner core has a deflection of at least 0.230 inch under a load of 200 pounds. The core has a deflection of at least 0.100 inch under a load of 200 pounds. The inner mantle layer is disposed over the outer core. The inner mantle layer has a thickness ranging from 0.025 inch to 0.070 inch. The inner mantle layer is composed of an ionomer material. The inner mantle layer material has a plaque Shore D hardness ranging from 40 to 65. The outer mantle layer is disposed over the inner mantle layer. The outer mantle layer has a thickness ranging from 0.025 inch to 0.040 inch. The outer mantle layer is composed of an ionomer material. The outer mantle layer material has a plaque Shore D hardness ranging from 55 to 71. The cover layer is disposed over the outer mantle layer. The cover layer has a thickness ranging from 0.025 inch to 0.040 inch. The cover layer is composed of a thermoplastic polyurethane material. The cover layer material has a plaque Shore D hardness ranging from 30 to 50, and an on-cover Shore D hardness less than 56. The golf ball has a core compression ratio (CCR)≥150, wherein CCR=(an inner core deflection×100)/(outer core volume×dual core deflection) and wherein the inner core defection value is in inches under a load of 200 pounds, the outer core volume is in inches cubed, and the dual core deflection is in inches under a load of 200 pounds.

Another aspect of the present invention is a golf ball comprising a dual core, dual mantle and TPU cover. The core comprises an inner core and an outer core disposed over the inner core. The inner core has a deflection of at least 0.230 inch under a load of 200 pounds. The core has a deflection of at least 0.100 inch under a load of 200 pounds. The inner mantle layer is disposed over the outer core. The inner mantle layer has a thickness ranging from 0.025 inch to 0.070 inch. The inner mantle layer is composed of an ionomer material. The inner mantle layer material has a plaque Shore D hardness ranging from 40 to 65. The outer mantle layer is disposed over the inner mantle layer. The outer mantle layer has a thickness ranging from 0.025 inch to 0.040 inch. The outer mantle layer is composed of an ionomer material. The outer mantle layer material has a plaque Shore D hardness ranging from 55 to 71. The cover layer is disposed over the outer mantle layer. The cover has a thickness ranging from 0.025 inch to 0.040 inch. The cover layer is composed of a thermoplastic polyurethane material. The cover layer material has a plaque Shore D hardness ranging from 30 to 50, and an on-cover Shore D hardness less than 56. The golf ball has a core compression ratio (CCR)≥125, wherein CCR=(an inner core deflection×100)/(outer core volume×dual core deflection) and wherein the inner core defection value is in inches under a load of 200 pounds, the outer core volume is in inches cubed, and the dual core deflection is in inches under a load of 200 pounds, and wherein a diameter of the core is less than 1.495 inches.

Another aspect of the present invention is a golf ball having a dual core, dual mantle and over. The core comprises an inner core and an outer core disposed over the inner core. The inner core has a deflection of at least 0.230 inch under a load of 200 pounds. The core has a deflection of at least 0.100 inch under a load of 200 pounds. The inner mantle layer is disposed over the core. The inner mantle layer has a thickness ranging from 0.025 inch to 0.070 inch. The inner mantle layer is composed of an ionomer material. The inner mantle layer material has a plaque Shore D hardness ranging from 40 to 65. The outer mantle layer is disposed over the inner mantle layer. The outer mantle layer has a thickness ranging from 0.025 inch to 0.040 inch. The outer mantle layer is composed of an ionomer material. The outer mantle layer material has a plaque Shore D hardness ranging from 55 to 71. The cover layer is disposed over the outer mantle layer. The cover has a thickness ranging from 0.025 inch to 0.050 inch. The cover layer is composed of an ionomer material. The cover layer material has a plaque Shore D hardness ranging from 50 to 65. The golf ball has a core compression ratio (CCR)≥150, wherein CCR=(an inner core deflection×100)/(outer core volume×dual core deflection) and wherein the inner core defection value is in inches under a load of 200 pounds, the outer core volume is in inches cubed, and the dual core deflection is in inches under a load of 200 pounds.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
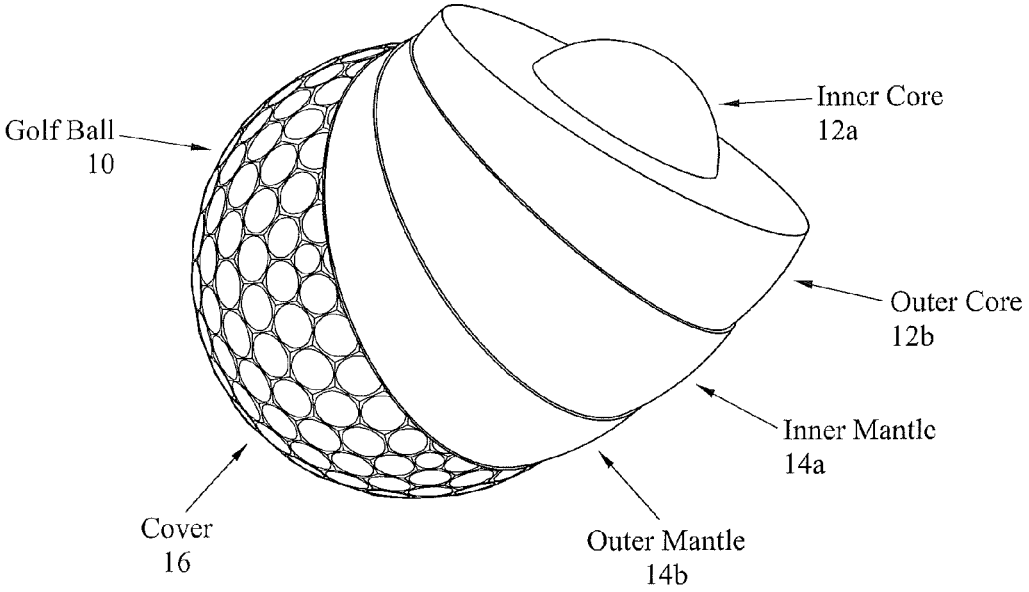
FIG. 1 is an exploded partial cut-away view of a golf ball.
Figure 2:
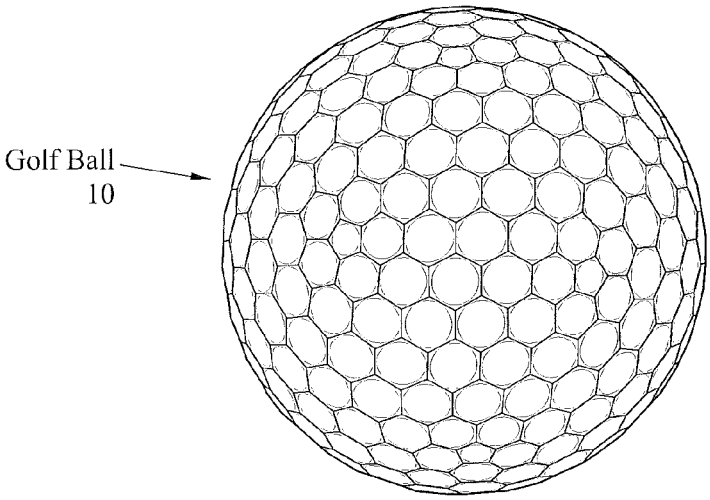
FIG. 2 is top perspective view of a golf ball.
Figure 3:
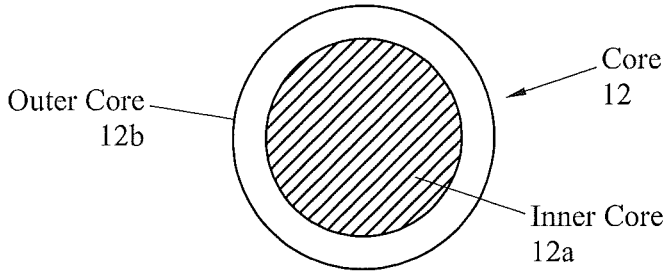
FIG. 3 is a cross-sectional view of a core component of a golf ball.
Figure 4:
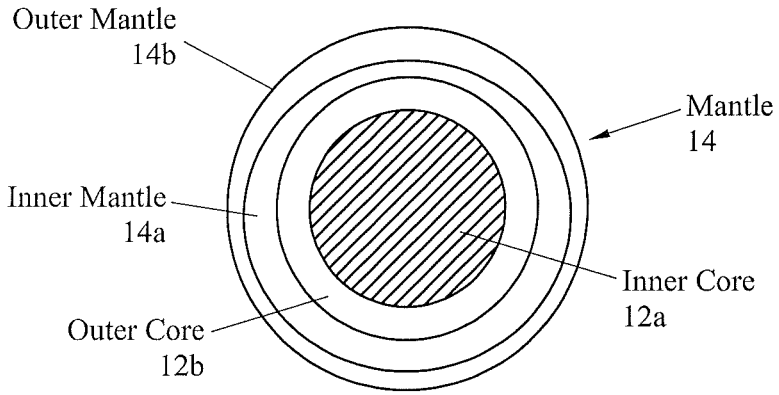
FIG. 4 is a cross-sectional view of a core component and a mantle component of a golf ball.
Figure 5:
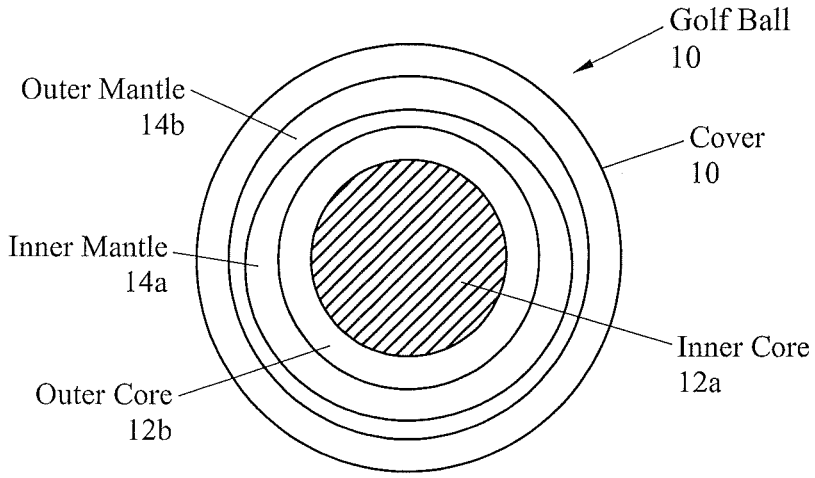
FIG. 5 is a cross-sectional view of an inner core layer, an outer core layer, an inner mantle layer, an outer mantle layer and a cover layer of a golf ball.

The present invention is directed to a golf ball comprising a dual-core component, a dual mantle component and a cover layer.

A preferred embodiment of a golf ball 10 is shown in FIGS. 1-5. The golf ball 10 comprises an inner core 12*a*, an outer core 12*b*, an inner mantle 14*a*, an outer mantle 14*b* and a cover 16. The golf ball 10 preferably has a diameter of at least 1.68 inches, a mass ranging from 45 grams to 47 grams, and a core compression ratio (CCR)≥150.

The cover 16 is preferably composed of a thermoplastic polyurethane material, and preferably has a thickness ranging from 0.025 inch to 0.04 inch, and more preferably ranging from 0.03 inch to 0.04 inch. The material of the cover 16 preferably has a Shore D plaque hardness ranging from 30 to 60, and more preferably from 40 to 50. The Shore D hardness measured on the cover 16 is preferably less than 56 Shore D. Preferably the cover 16 has a Shore A hardness of less than 96. Alternatively, the cover 16 is composed of a thermoplastic polyurethane/polyurea material. One example is disclosed in U.S. Pat. No. 7,367,903 for a Golf Ball, which is hereby incorporated by reference in its entirety.

The mantle component 14 is composed of the inner mantle layer 14*a* and the outer mantle layer 14*b*. The mantle component 14 preferably has a thickness ranging from 0.05 inch to 0.15 inch, and more preferably from 0.06 inch to 0.08 inch. The outer mantle layer 14*b* is preferably composed of a blend of ionomer materials. One preferred embodiment comprises SURLYN 9150 material, SURLYN 8940 material, a SURLYN AD1022 material, and a masterbatch. The SURLYN 9150 material is preferably present in an amount ranging from 20 to 45 weight percent of the cover, and more preferably 30 to 40 weight percent. The SURLYN 8945 is preferably present in an amount ranging from 15 to 35 weight percent of the cover, more preferably 20 to 30 weight percent, and most preferably 26 weight percent. The SURLYN 9945 is preferably present in an amount ranging from 30 to 50 weight percent of the cover, more preferably 35 to 45 weight percent, and most preferably 41 weight percent. The SURLYN 8940 is preferably present in an amount ranging from 5 to 15 weight percent of the cover, more preferably 7 to 12 weight percent, and most preferably 10 weight percent.

SURLYN 8320, from DuPont, is a very-low modulus ethylene/methacrylic acid copolymer with partial neutralization of the acid groups with sodium ions. SURLYN 8945, also from DuPont, is a high acid ethylene/methacrylic acid copolymer with partial neutralization of the acid groups with sodium ions. SURLYN 9945, also from DuPont, is a high acid ethylene/methacrylic acid copolymer with partial neutralization of the acid groups with zinc ions. SURLYN 8940, also from DuPont, is an ethylene/methacrylic acid copolymer with partial neutralization of the acid groups with sodium ions.

The inner mantle layer 14*a* is preferably composed of a blend of ionomers, preferably comprising a terpolymer and at least two high acid (greater than 18 weight percent) ionomers neutralized with sodium, zinc, magnesium, or other metal ions. The material for the inner mantle layer preferably has a Shore D plaque hardness ranging preferably from 35 to 77, more preferably from 36 to 44, a most preferably approximately 40. The thickness of the outer mantle layer preferably ranges from 0.025 inch to 0.050 inch, and is more preferably approximately 0.037 inch. The mass of an insert including the dual core and the inner mantle layer preferably ranges from 32 grams to 40 grams, more preferably from 34 to 38 grams, and is most preferably approximately 36 grams. The inner mantle layer 14*b* is alternatively composed of a HPF material available from DuPont. Alternatively, the inner mantle layer 14*b* is composed of a material such as disclosed in Kennedy, III et al., U.S. Pat. No. 7,361,101 for a Golf Ball And Thermoplastic Material, which is hereby incorporated by reference in its entirety.

The outer mantle layer 14*b* is preferably composed of a blend of ionomers, preferably comprising at least two high acid (greater than 18 weight percent) ionomers neutralized with sodium, zinc, or other metal ions. The blend of ionomers also preferably includes a masterbatch. The material of the outer mantle layer 14*b* preferably has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. The mass of the entire insert including the core 12, the inner mantle layer 14*a* and the outer mantle layer 14*b* preferably ranges from 38 grams to 43 grams, more preferably from 39 to 41 grams, and is most preferably approximately 41 grams.

In an alternative embodiment, the inner mantle layer 14*a* is preferably composed of a blend of ionomers, preferably comprising at least two high acid (greater than 18 weight percent) ionomers neutralized with sodium, zinc, or other metal ions. The blend of ionomers also preferably includes a masterbatch. In this embodiment, the material of the inner mantle layer 14*a* has a Shore D plaque hardness ranging preferably from 55 to 75, more preferably from 65 to 71, and most preferably approximately 67. The thickness of the outer mantle layer preferably ranges from 0.025 inch to 0.040 inch, and is more preferably approximately 0.030 inch. Also in this embodiment, the outer mantle layer 14*b* is composed of a blend of ionomers, preferably comprising a terpolymer and at least two high acid (greater than 18 weight percent) ionomers neutralized with sodium, zinc, magnesium, or other metal ions. In this embodiment, the material for the outer mantle layer 14*b* preferably has a Shore D plaque hardness ranging preferably from 35 to 77, more preferably from 36 to 44, a most preferably approximately 40. The thickness of the outer mantle layer 14*b* preferably ranges from 0.025 inch to 0.100 inch, and more preferably ranges from 0.070 inch to 0.090 inch.

In yet another embodiment wherein the inner mantle layer 14*a* is thicker than the outer mantle layer 14*b* and the outer mantle layer 14*b* is harder than the inner mantle layer 14*a*, the inner mantle layer 14*a* is composed of a blend of ionomers, preferably comprising a terpolymer and at least two high acid (greater than 18 weight percent) ionomers neutralized with sodium, zinc, magnesium, or other metal ions. In this embodiment, the material for the inner mantle layer 14*a* has a Shore D plaque hardness ranging preferably from 30 to 77, more preferably from 30 to 50, and most preferably approximately 40. In this embodiment, the material for the outer mantle layer 14*b* has a Shore D plaque hardness ranging preferably from 40 to 77, more preferably from 50 to 71, and most preferably approximately 67. In this embodiment, the thickness of the inner mantle layer 14*a* preferably ranges from 0.030 inch to 0.090 inch, and the thickness of the outer mantle layer 14*b* ranges from 0.025 inch to 0.070 inch.

Preferably the inner core 12*a* has a diameter ranging from 0.75 inch to 1.20 inches, more preferably from 0.85 inch to 1.05 inch, and most preferably approximately 0.95 inch. Preferably the inner core 12*a* has a Shore D hardness ranging from 20 to 50, more preferably from 25 to 40, and most preferably approximately 35. Preferably the inner core is formed from a polybutadiene, zinc diacrylate, zinc oxide, zinc stearate, a peptizer and peroxide. Preferably the inner core has a mass ranging from 5 grams to 15 grams, 7 grams to 10 grams and most preferably approximately 8 grams.

Preferably the outer core 12*b* has a diameter ranging from 1.25 inch to 1.55 inches, more preferably from 1.40 inch to 1.5 inch, and most preferably approximately 1.5 inch. Preferably the inner core has a Shore D surface hardness ranging from 40 to 65, more preferably from 50 to 60, and most preferably approximately 56. Preferably the inner core is formed from a polybutadiene, zinc diacrylate, zinc oxide, zinc stearate, a peptizer and peroxide. Preferably the combined inner core and outer core have a mass ranging from 25 grams to 35 grams, 30 grams to 34 grams and most preferably approximately 32 grams.

Figure 6:
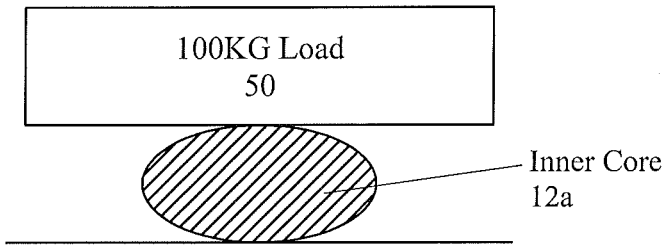
FIG. 6 is a cross-sectional view of an inner core layer under a 100 kilogram load.
Figure 7:
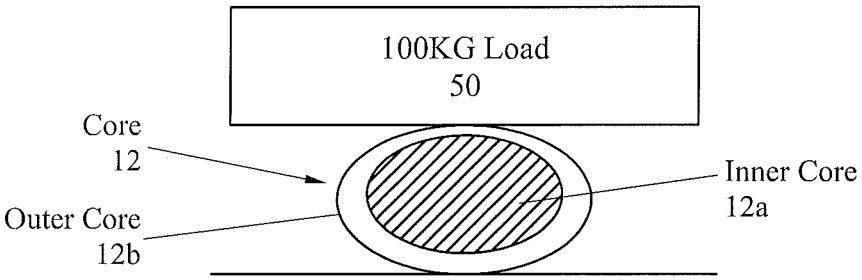
FIG. 7 is a cross-sectional view of a core under a 100 kilogram load.

Preferably the inner core 12*a* has a deflection of at least 0.230 inch under a load of 220 pounds, and the core 12 has a deflection of at least 0.080 inch under a load of 200 pounds. As shown in FIGS. 6 and 7, a mass 50 is loaded onto an inner core 12*a* and a core 12. As shown in FIGS. 6 and 7, the mass is 100 kilograms, approximately 220 pounds. Under a load of 100 kilograms, the inner core 12*a* preferably has a deflection from 0.230 inch to 0.300 inch. Under a load of 100 kilograms, preferably the core 12 has a deflection of 0.08 inch to 0.150 inch. Alternatively, the load is 200 pounds (approximately 90 kilograms), and the deflection of the core 12 is at least 0.080 inch. Further, a compressive deformation from a beginning load of 10 kilograms to an ending load of 130 kilograms for the inner core 12*a* ranges from 4 millimeters to 7 millimeters and more preferably from 5 millimeters to 6.5 millimeters. The dual core deflection differential allows for low spin off the tee to provide greater distance, and high spin on approach shots.

In a particularly preferred embodiment of the invention, the golf ball preferably has an aerodynamic pattern such as disclosed in Simonds et al., U.S. Pat. No. 7,419,443 for a Low Volume Cover For A Golf Ball, which is hereby incorporated by reference in its entirety. Alternatively, the golf ball has an aerodynamic pattern such as disclosed in Simonds et al., U.S. Pat. No. 7,338,392 for An Aerodynamic Surface Geometry For A Golf Ball, which is hereby incorporated by reference in its entirety. Alternatively, the golf ball has an aerodynamic pattern such as disclosed in Simonds et al., U.S. Pat. No. 7,468,007 for a Dual Dimple Surface Geometry For A Golf Ball, which is hereby incorporated by reference in its entirety.

Various aspects of the present invention golf balls have been described in terms of certain tests or measuring procedures. These are described in greater detail as follows.

As used herein, "Shore D hardness" of the golf ball layers are measured generally in accordance with ASTM D-2240 type D, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore D hardness of the cover is measured while the cover remains over the mantles and cores. When a hardness measurement is made on the golf ball, the Shore D hardness is preferably measured at a land area of the cover.

As used herein, "Shore A hardness" of a cover is measured generally in accordance with ASTM D-2240 type A, except the measurements may be made on the curved surface of a component of the golf ball, rather than on a plaque. If measured on the ball, the measurement will indicate that the measurement was made on the ball. In referring to a hardness of a material of a layer of the golf ball, the measurement will be made on a plaque in accordance with ASTM D-2240. Furthermore, the Shore A hardness of the cover is measured while the cover remains over the mantles and cores. When a hardness measurement is made on the golf ball, Shore A hardness is preferably measured at a land area of the cover The resilience or coefficient of restitution (COR) of a golf ball is the constant "e," which is the ratio of the relative velocity of an elastic sphere after direct impact to that before impact. As a result, the COR ("e") can vary from 0 to 1, with 1 being equivalent to a perfectly or completely elastic collision and 0 being equivalent to a perfectly or completely inelastic collision.

COR, along with additional factors such as club head speed, club head mass, ball weight, ball size and density, spin rate, angle of trajectory and surface configuration as well as environmental conditions (e.g. temperature, moisture, atmospheric pressure, wind, etc.) generally determine the distance a ball will travel when hit. Along this line, the distance a golf ball will travel under controlled environmental conditions is a function of the speed and mass of the club and size, density and resilience (COR) of the ball and other factors. The initial velocity of the club, the mass of the club and the angle of the ball's departure are essentially provided by the golfer upon striking. Since club head speed, club head mass, the angle of trajectory and environmental conditions are not determinants controllable by golf ball producers and the ball size and weight are set by the U.S.G.A., these are not factors of concern among golf ball manufacturers. The factors or determinants of interest with respect to improved distance are generally the COR and the surface configuration of the ball.

The coefficient of restitution is the ratio of the outgoing velocity to the incoming velocity. In the examples of this application, the coefficient of restitution of a golf ball was measured by propelling a ball horizontally at a speed of 125+/−5 feet per second (fps) and corrected to 125 fps against a generally vertical, hard, flat steel plate and measuring the ball's incoming and outgoing velocity electronically. Speeds were measured with a pair of ballistic screens, which provide a timing pulse when an object passes through them. The screens were separated by 36 inches and are located 25.25 inches and 61.25 inches from the rebound wall. The ball speed was measured by timing the pulses from screen 1 to screen 2 on the way into the rebound wall (as the average speed of the ball over 36 inches), and then the exit speed was timed from screen 2 to screen 1 over the same distance. The rebound wall was tilted 2 degrees from a vertical plane to allow the ball to rebound slightly downward in order to miss the edge of the cannon that fired it. The rebound wall is solid steel.

As indicated above, the incoming speed should be 125±5 fps but corrected to 125 fps. The correlation between COR and forward or incoming speed has been studied and a correction has been made over the ±5 fps range so that the COR is reported as if the ball had an incoming speed of exactly 125.0 fps.

The measurements for deflection, compression, hardness, and the like are preferably performed on a finished golf ball as opposed to performing the measurement on each layer during manufacturing.

Preferably, in a five layer golf ball comprising an inner core, an outer core, an inner mantle layer, an outer mantle layer and a cover, the hardness/compression of layers involve an inner core with the greatest deflection (lowest hardness), an outer core (combined with the inner core) with a deflection less than the inner core, an inner mantle layer with a hardness less than the hardness of the combined outer core and inner core, an outer mantle layer with the hardness layer of the golf ball, and a cover with a hardness less than the hardness of the outer mantle layer. These measurements are preferably made on a finished golf ball that has been torn down for the measurements.

Preferably the inner mantle layer is thicker than the outer mantle layer or the cover layer. The dual core and dual mantle golf ball creates an optimized velocity-initial velocity ratio (Vi/IV), and allows for spin manipulation. The dual core provides for increased core compression differential resulting in a high spin for short game shots and a low spin for driver shots. A discussion of the USGA initial velocity test is disclosed in Yagley et al., U.S. Pat. No. 6,595,872 for a Golf Ball With High Coefficient Of Restitution, which is hereby incorporated by reference in its entirety. Another example is Bartels et al., U.S. Pat. No. 6,648,775 for a Golf Ball With High Coefficient Of Restitution, which is hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. A golf ball comprising:

a core comprising an inner core and an outer core disposed over the inner core, the inner core having a deflection of at least 0.230 inch under a load of 200 pounds, and the core having a deflection of at least 0.100 inch under a load of 200 pounds;

an inner mantle layer disposed over the outer core, the inner mantle layer having a thickness ranging from 0.025 inch to 0.070 inch, the inner mantle layer composed of a blend of ionomers, the inner mantle layer material having a plaque Shore D hardness ranging from 55 to 75;

an outer mantle layer disposed over the inner mantle layer, the outer mantle layer having a thickness ranging from 0.025 inch to 0.040 inch, the outer mantle layer composed of a blend of ionomers, the outer mantle layer material having a plaque Shore D hardness ranging from 36 to 44; and a cover layer disposed over the outer mantle layer, the cover layer having a thickness ranging from 0.025 inch to 0.040 inch, the cover composed of a thermoplastic polyurethane material, the cover layer material having a plaque Shore D hardness ranging from 30 to 50, and an on-cover Shore D hardness less than 56;

wherein the golf ball has a core compression ratio (CCR) ≥150, wherein CCR=(an inner core deflection×100)/(outer core volume×dual core deflection)

and wherein the inner core defection value is in inches under a load of 200 pounds, the outer core volume is in inches cubed, and the dual core deflection is in inches under a load of 200 pounds.

2. The golf ball according to claim 1 wherein the outer core is composed of a polybutadiene material, zinc penta-chloride-thiophenol, organic peroxide, zinc stearate, zinc diacrylate and zinc oxide.

3. The golf ball according to claim 1 wherein the inner core is composed of a polybutadiene material, zinc penta-chloride-thiophenol, organic peroxide, zinc stearate, zinc diacrylate and zinc oxide.

4. A golf ball comprising:

a core comprising an inner core and an outer core disposed over the inner core, the inner core having a deflection of at least 0.230 inch under a load of 200 pounds, and the core having a deflection of at least 0.100 inch under a load of 200 pounds;

an inner mantle layer disposed over the outer core, the inner mantle layer having a thickness ranging from 0.025 inch to 0.070 inch, the inner mantle layer composed of a blend of ionomers, the inner mantle layer material having a plaque Shore D hardness ranging from 55 to 75;

an outer mantle layer disposed over the inner mantle layer, the outer mantle layer having a thickness ranging from 0.025 inch to 0.040 inch, the outer mantle layer composed of a blend of ionomers, the outer mantle layer material having a plaque Shore D hardness ranging from 36 to 44; and a cover layer disposed over the outer mantle layer, the cover layer having a thickness ranging from 0.025 inch to 0.040 inch, the cover composed of a thermoplastic polyurethane material, the cover layer material having a plaque Shore D hardness ranging from 30 to 50, and an on-cover Shore D hardness less than 56;

wherein the golf ball has a core compression ratio (CCR) ≥125, wherein CCR=(an inner core deflection×100)/(outer core volume×dual core deflection) and wherein the inner core defection value is in inches under a load of 200 pounds, the outer core volume is in inches cubed, and the dual core deflection is in inches under a load of 200 pounds, and wherein a diameter of the core is less than 1.495 inches.

5. A golf ball comprising:

a core comprising an inner core and an outer core disposed over the inner core, the inner core having a deflection of at least 0.230 inch under a load of 200 pounds, and the core having a deflection of at least 0.100 inch under a load of 200 pounds;

an inner mantle layer disposed over the core, the inner mantle layer having a thickness ranging from 0.025 inch to 0.070 inch, the inner mantle layer composed of a blend of ionomers, the inner mantle layer material having a plaque Shore D hardness ranging from 55 to 75;

an outer mantle layer disposed over the inner mantle layer, the outer mantle layer having a thickness ranging from 0.025 inch to 0.040 inch, the outer mantle layer composed of a blend of ionomers, the outer mantle layer material having a plaque Shore D hardness ranging from 36 to 44;

and a cover layer disposed over the outer mantle layer, the cover layer having a thickness ranging from 0.025 inch to 0.050 inch, the cover composed of an ionomer material, the cover layer material having a plaque Shore D hardness ranging from 50 to 65;

wherein the golf ball has a core compression ratio (CCR) ≥150, wherein CCR=(an inner core deflection×100)/(outer core volume×dual core deflection)

and wherein the inner core defection value is in inches under a load of 200 pounds, the outer core volume is in inches cubed, and the dual core deflection is in inches under a load of 200 pounds.

* * * * *